US005402302A

United States Patent [19]

Boucheron

[11] Patent Number: 5,402,302

[45] Date of Patent: Mar. 28, 1995

[54] SUPPLY CIRCUIT FOR ELECTROMAGNETIC RELAYS

[75] Inventor: Jean-Louis Boucheron, Savigny le Temple, France

[73] Assignee: Valeo Electronique, Voisins-Le-Bretonneux, France

[21] Appl. No.: 35,746

[22] Filed: Mar. 23, 1993

[30] Foreign Application Priority Data

Mar. 24, 1992 [FR] France ..... 92 03503

[51] Int. Cl.[6] ..... H01H 47/00

[52] U.S. Cl. ..... 361/160; 361/152

[58] Field of Search ..... 361/139, 143, 152, 154, 361/160, 170, 187, 189, 190, 194, 195

[56] References Cited

U.S. PATENT DOCUMENTS

| | | | |
|---|---|---|---|
| 4,180,026 | 12/1979 | Schulzke et al. | 361/154 |
| 4,688,139 | 8/1987 | Nagata et al. | 361/154 |
| 4,989,116 | 1/1991 | Gruner et al. | 361/154 |
| 5,053,911 | 10/1991 | Kopec et al. | 361/154 |
| 5,107,391 | 4/1992 | Siepmann | 361/168.1 |

FOREIGN PATENT DOCUMENTS

| | | |
|---|---|---|
| 3415649 | 11/1985 | Germany . |
| 0309755 | 8/1988 | Germany . |
| 0392058 | 4/1989 | Germany . |
| 3733091 | 4/1989 | Germany . |
| 58-105528 | 6/1983 | Japan . |

OTHER PUBLICATIONS

IBM Technical Disclosure Bulletin; vol. 27, No. 2, Jul. 1984, pp. 1057–1058, Renz et al.

*Primary Examiner*—Jeffrey A. Gaffin
*Attorney, Agent, or Firm*—Morgan & Finnegan

[57] ABSTRACT

An electromagnetic relay, which may be associated with further relays, has a supply circuit which includes means for generating a holding voltage for holding the relay contacts closed. This voltage generating means is activated and de-activated by receipt of an appropriate command signal for respectively closing and opening the relay contacts. The supply circuit includes a chopping circuit for chopping the highest unidirectional voltage available on the circuit, according to a cyclic ratio which is predetermined so as to provide a holding condition for the relay contacts at an intermediate voltage lower than the said highest available voltage, and with a low current. It also includes a circuit for generating a controlled closing voltage during the transition from the open to the closed position of the relay contacts. The invention is applicable especially to batteries of relays for use in motor vehicles.

10 Claims, 4 Drawing Sheets

SUPPLY CIRCUIT FOR ELECTROMAGNETIC RELAYS

FIELD OF THE INVENTION

The present invention relates to supply circuits for electromagnetic relays.

BACKGROUND OF THE INVENTION

A type of electro magnetic relay is known in the prior art in which, after the relay has received a signal which commands closure of its contacts, a holding voltage must be applied to the relay coil in order to hold the contacts in their closed position for so long as a further command, for opening the contacts, is not received. This type of relay may be provided with a return spring for moving the moving contact of the relay away from the other contact so as to open the contacts. The open position is also sometimes known as the "non-adhered contact position", and in this specification the position of the contacts in which they are firmly engaged together will sometimes be referred to in terms of "adhesion", it being understood that this does not imply actual bonding.

The above mentioned holding voltage is usually of a lower value than the initial voltage which energizes the relay coil so as to cause its moving contact to be brought into engagement with the other contact. For this reason, during the holding phase, the current which is consumed by the relay coil, under the reduced holding voltage, is also smaller; this is because the holding state only requires the provision of enough electrical energy to counterbalance the effect of the return spring of the relay. The relay has only a very small air gap when closed, while, since in the open condition the air gap is greater, in order to close the contacts there is a need for a higher magnetising current.

In some applications, relay boxes are required which call for a battery of relays, some of which may be held simultaneously in their closed (or adhered-contact) position. Due to the high cumulative current consumption in such a battery of relays, and in particular because the resistance of the relay coils is quite low, a large amount of heat is given off. This is the main drawback of these prior art arrangements.

An alternative technology does exist, in which the electromagnetic relays are replaced by semiconductors. However, this technique has the disadvantage of increased cost, while in general terms the control circuits of such semiconductor interruptors are considerably more complicated.

DISCUSSION OF THE INVENTION

An object of the present invention is to overcome this drawback of the prior art, without having to have recourse to the use of semiconductor type power interruptors.

In general terms the present invention offers improvements to a supply circuit for electromagnetic relays, especially those which are provided for the purpose of controlling electrical loads in a vehicle having an electric supply battery, the supply circuit being of the type comprising means for generating a holding voltage for holding at least one relay in its closed position, this means being activated by receipt of a command signal for the closing of the relay contacts, and being de-activated on receipt of another command signal for opening of the relay contacts.

Such a supply circuit is characterized in that it includes a chopping circuit for chopping a unidirectional voltage, which is produced for example by a generator and/or a battery mounted in a vehicle, in a predetermined cyclic ratio, whereby to supply at least one relay at an intermediate voltage which is lower than the voltage required for closing the relay, and with a low current, in accordance with a condition for maintaining at least one said relay, connected to the output of the supply circuit, in its closed position.

Further features and advantages of the present invention will appear more clearly from a reading of the description which follows, of a preferred embodiment of the invention, by way of example only and with reference to the accompanying drawings.

DESCRIPTION OF A PREFERRED EMBODIMENT OF THE INVENTION

Figure 1:
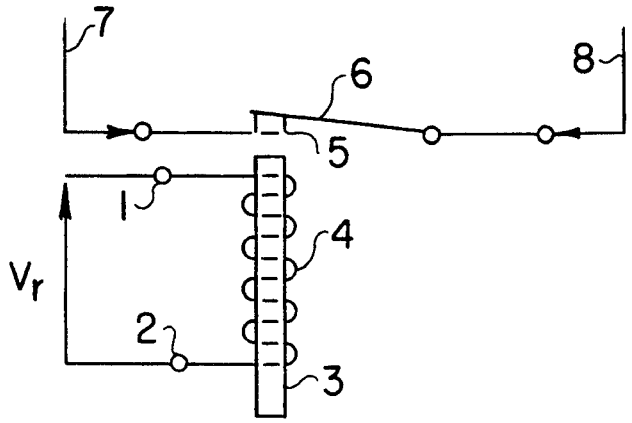
FIG. 1 (PRIOR ART)
FIG. 1 is a diagram of a conventional electromagnetic relay.

FIG. 1 shows an electromagnetic relay of the type with which the present invention is concerned. It comprises a coil 4 having two input terminals 1 and 2, to which a voltage Vr is applied when it is required to close the relay. The coil is wound around a yoke or core 3 of magnetic material. The relay has a movable armature, which is fixed to a contact leaf 6 and which is for example biased by means of a spring, so as to make or interrupt contact with a contact pad 5 connected to a pole 7 of the relay, the leaf 6 being connected to the other pole 8 of the relay. The armature is displaced between the open and closed positions of the relay by the electromagnet 3, 4. The poles 7 and 8 are such that high currents can be transmitted at high voltages.

Figure 2:
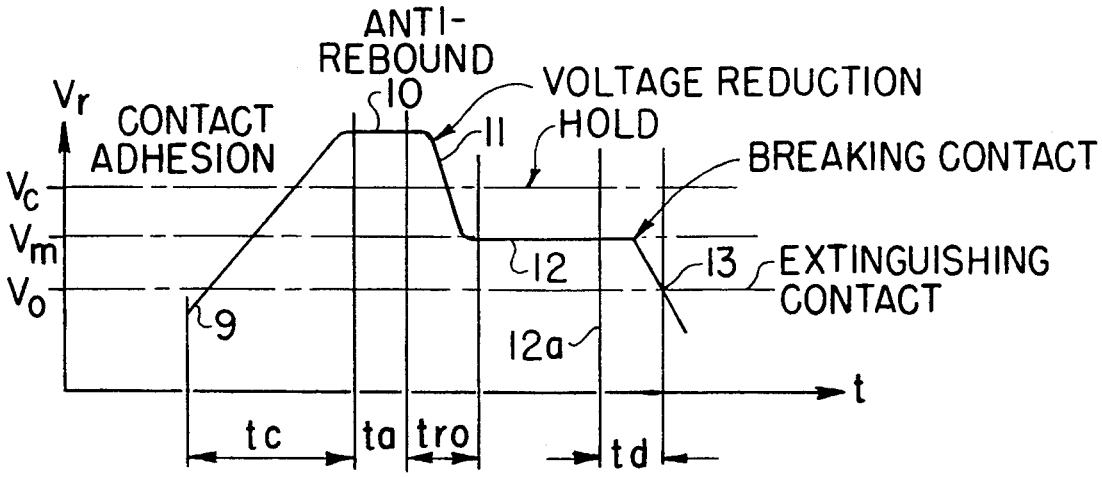
FIG. 2 (PRIOR ART)
FIG. 2 is a graph showing variations in the supply voltage across the terminals of the winding of the relay shown in FIG. 1.

Referring to FIG. 2, this shows the changes in the supply voltage Vr of the relay during one operating cycle of the relay shown in FIG. 1. At the initial instant, the voltage is less than a value Vo, and the relay is in its open position. A voltage Vr, which is greater than a value Vc, is then applied so as to bring the contacts 5 and 6 intimately together. This condition of intimate contact, or adhesion, is reached at the end of a time period tc during which the supply voltage Vr increases in a ramp 9. The voltage across the terminals of the coil is then maintained for a time period ta so as to prevent any rebound of the contacts, so that this period is an anti-rebound phase.

The voltage Vr is then allowed to reduce on a ramp 11 for a time period tm, down to a holding value Vm in the closed position 12 of the relay. So long as the contacts are required to be held closed, the voltage Vr across the terminals of the relay is held at the value Vm during an interval represented at 12 in FIG. 2, until a command to reopen the contacts, at the instant indicated at 12*a*, is applied to the supply circuit of the relay. When the voltage once again falls below the value Vo, at the end of a further time period td after receipt of the command for reopening the contacts at the instant 12*a*, the contacts 5 and 6 are separated from each other and the relay is then open extinguishing contact 13.

It is found that the holding voltage Vm is a value intermediate between the value Vc, or closing voltage, and the opening voltage Vo. For this reason, this voltage supports a current im which is large enough to produce a sufficient holding power $Pm=Vm\times im$.

The invention aims to reduce the value im of the holding current since, if the resistance of the coil is Rb, the thermal power emitted by the relay is $Pc=Rb\times im^2$. For this reason it is necessary to reduce the voltage across the terminals of the coil as much as possible, while still preserving a condition in which the contacts are held properly together, so limiting the heat which is dissipated in the coil. It is in fact sufficient in this case that the mean voltage applied to the coil should produce a large enough value of holding power Pm.

Figure 3:
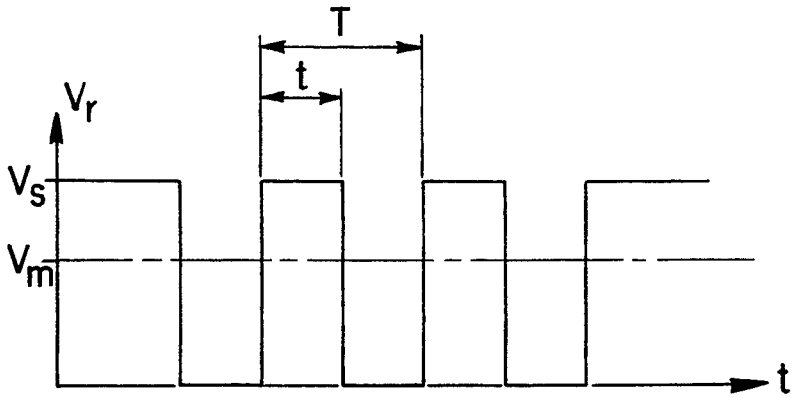
FIG. 3 is a graph showing one waveform for the holding voltage applied across the terminals of the relay by a supply circuit in accordance with the invention.

The holding current im in the coil is substantially reduced by a chopping circuit, which enables the supply voltage to be chopped in such a way as to synthesise a voltage across the terminals of the relay, in which the mean value of this voltage is of the same order as the holding voltage Vm. Referring to FIG. 3, this shows the waveform of a voltage which is chopped from the supply voltage Vs to the form of a succession of battlements or crenellations. In another embodiment, it is possible to use any other suitable waveform, in particular one which is adapted to reduce parasitic emissions.

In the waveform shown in FIG. 3, the cyclic ratio, that is to say the ratio between the duration of the holding period t, during which the voltage Vr is equal to the supply voltage Vs, and the chopping cycle period T, determines a mean voltage defined by $(t/T)\times Vs$. This mean voltage can accordingly be adjusted so that it has an adequate value which is predetermined by the known holding condition for a connected relay, by varying t, T or Vs.

In a preferred arrangement, for a given period T, a holding period tm is chosen such that the mean voltage is equal to the holding voltage $Vm=tm/T\times Vs$. Accordingly, it is found that it is possible to see a holding condition, in the closed position of the relay, while substantially reducing the value of the current consumed in the coil. In this way the electrical power consumption and release of heat are both reduced. In particular, the invention is applicable to batteries of relays which are arranged to be closed, either in groups or all together, in a switching system, especially for multiplexing lines in a motor vehicle. The supply circuit here described thus enables heat emission to be reduced, in particular, in the casing which contains the battery of relays.

Figure 4:
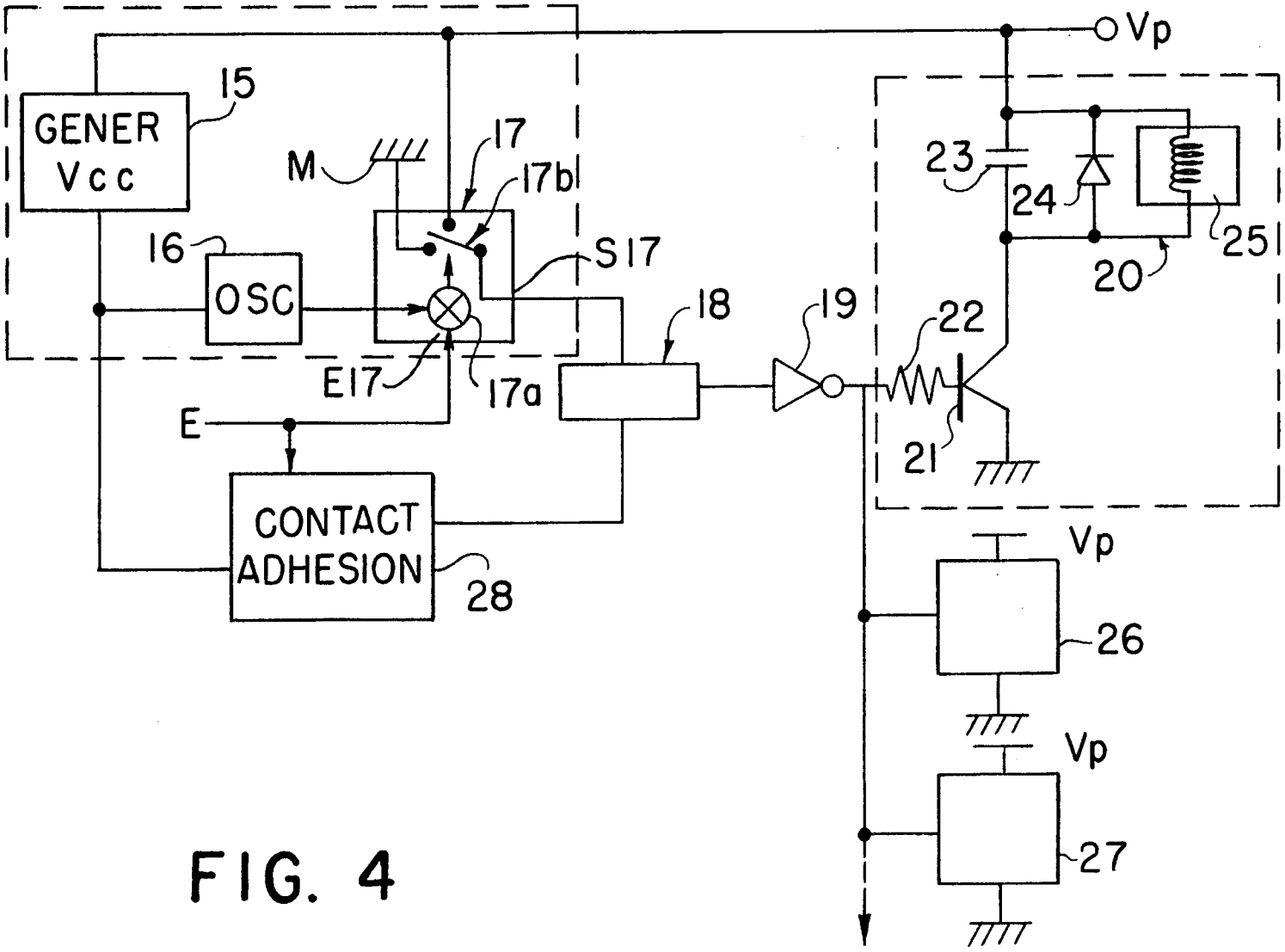
FIG. 4 is a diagram, generally in the form of a block diagram, showing the supply circuit in accordance with the invention.

FIG. 4 is a block diagram showing the general arrangement. In FIG. 4, a chopping circuit (indicated within a rectangle of broken lines) includes a unidirectional voltage generator 15 which produces a supply voltage Vcc from a supply voltage Vp, which is supplied for example from the positive terminal "+" of the battery carried in the vehicle. This supply voltage Vcc is supplied to the circuit to be described below.

In one embodiment, the supply circuit serves a battery of relays 25, 26, 27 etc.

It will be realised from the description below that one of the advantages of the invention is that it enables all the voltages derived from the voltage Vp of the on-board battery in the vehicle to be synthesised. In particular, this feature enables the relay to remain in its held or closed position even in the event of a reduction in the polarising voltage Vp, which can happen for example when the battery is in a low state of charge.

In FIG. 4, the unidirectional voltage generator 15 includes an input terminal at the polarising voltage Vp, which is connected to the positive terminal of the vehicle battery. The circuit also includes an electrical earth or ground M. In one embodiment, this ground is in the form of a logic ground circuit, connected only to the circuit.

Figure 5:
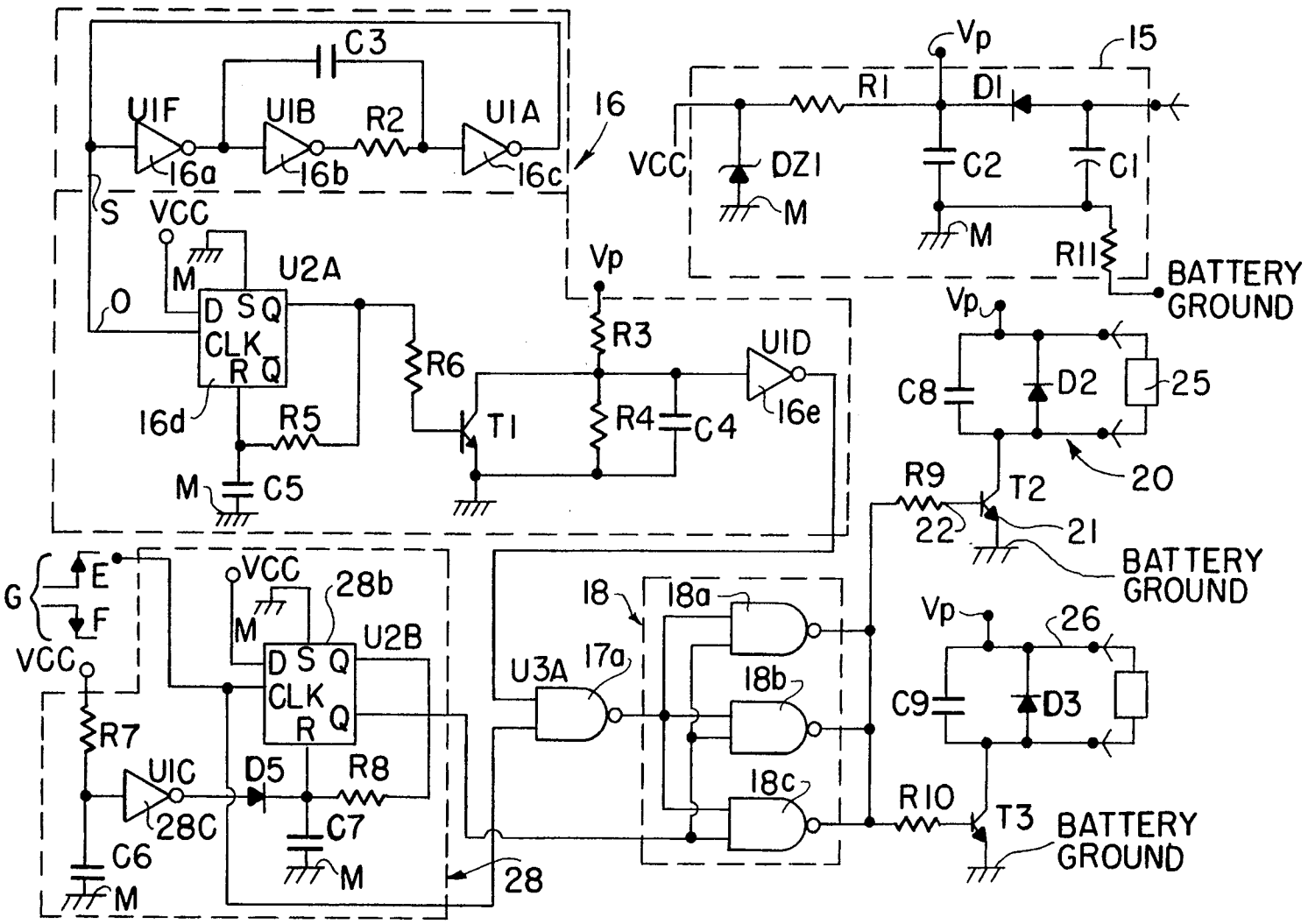
FIG. 5 is a circuit diagram showing a preferred form of the circuit of the invention.

In a preferred embodiment, which is shown in the voltage generator 15 in FIG. 5, the negative terminal "−" of the battery, also called "Battery Ground", is connected to the terminal which is itself connected to the voltage Vp through a circuit which includes two capacitors C1 (in series with a diode D1) and C2 in parallel. A terminal G, which is connected to the common point between the anode of the diode D1 and the capacitor C1, receives the command F for opening the relay or the command E for closing it. A resistor R11 is interposed before the battery ground terminal. Finally, the cathode of the diode D1 is connected to a first side of a resistor R1, the other side of which is connected to the cathode of a Zener diode DZ1. The anode of the latter is connected to ground M. The output of the voltage generator 15 is applied on the cathode of the diode DZ1.

Reverting now to FIG. 4, the unidirectional supply voltage Vcc which is produced at the output of the voltage generator 15 is passed, in particular, to an oscillator 16, which produces a waveform such as that shown in FIG. 3. The period T of the oscillator is so set as to produce a sufficiently large holding voltage across the ends of the coil of the relay to enable it to hold the relay contacts in the closed position. The voltage generator 15 also serves to supply a unidirectional voltage to the logic part of the supply circuit.

The command signal E for closing the relay is also received on a control input of the circuit. This signal may be produced by a computer, or from a keyboard or a security device, for example. A composing circuit 17 receives the command E on an input E17, and the output from the oscillator 16 on another input. The composing circuit 17 also receives a unidirectional voltage, such as the highest available voltage Vp, which is connected to one terminal of an interruptor 17*b*. Another terminal of the interruptor 17*b* is connected to the electrical ground M. Finally, the output terminal of the interruptor 17*b* is connected to the output S17 of the composing circuit 17.

In addition, the composing (or combination) circuit 17 includes an adding circuit 17*a*, for example an AND gate, a first input of which receives the output signal from the oscillator 16, with its second input receiving the command signal E for closing the relay. When the signal E is at the high level "1", the interruptor 17*b* chops the voltage Vp into the waveform shown in FIG. 3, with a period T which is determined by the oscillator 16.

More precisely, the chopping circuit comprises a composing circuit 17 which includes:

an adding circuit 17*a* such as an AND gate, a first input of which receives the output signal from the oscillator 16, with its second input E17 receiving a closing command signal for the relay from a control element, with an output of the adding circuit producing an output signal which corresponds to the oscillations, of predetermined period T, if the command signal E is active; and an interruptor 17*b*, a first input terminal of which receives a unidirectional voltage, such as the highest available voltage Vp, with its second input terminal being connected to the electrical ground M, and its output terminal connected to an output S17 of the composing circuit 17; the interruptor 17*b* switches between its first and second input terminals according to the output signal produced by the adding circuit 17*a*.

In addition, the closing command signal E is fed to a circuit 28 for generating an adhesion pulse which is adapted to cause adhesion between the contacts of the relay 25, or of any other relay that may be supplied by the supply circuit.

In this connection, and as has been described with reference to FIG. 2, the voltage which enables the relay to switch from its open position in which the two contacts are spaced apart, to its closed position in which the contacts are held together, requires the application of a voltage Vr (which is at least equal to a threshold represented by the voltage Vc) across the coil of the relay, this voltage Vr being higher than the holding voltage. In a preferred embodiment, the supply circuit applies the full supply voltage Vp continuously to the coil, due to the action of the contact adhesion pulse generator 28, which ceases to play any part after the period tc shown in FIG. 2.

The outputs of the chopping circuit and of the pulse generator 28, are led into another composing circuit 18, which may for example be an OR gate, the output of which is taken to a current amplifier 19. The amplified current output of the amplifier 19 is fed to the control input of a circuit 20 which contains the relay 25, and which is connected between the polarising voltage Vp of the battery and ground. The control input of the circuit 20 is connected to the base of a switching transistor 21 through a polarising resistor 22. When the transistor 21 is made conductive by the application of a constant voltage produced by the pulse generator 28, a current for closing the relay 25 is produced. The coil of the relay 25 is supplied in parallel with a protection circuit 23, 24, notably for the purpose of limiting overvoltages. Such a protection circuit comprises a capacitor 23 and a protective diode 24.

Once the relay contacts are in intimate ("adhered") contact with each other, the chopping circuit generates the oscillations which are adapted by the amplifier 19, and which put the transistor 21 into alternate conductive and non-conductive states, so as to synthesise the voltage Vm across the ends of the coil of the relay 25. Since transmission of the oscillations is maintained by the signal E, the voltage Vm actually supplied to the relay coil is reduced at the terminals of the transistor 21. In this way, a mean holding voltage is synthesised, having a value lying intermediate between the polarizing voltage Vp and that of ground. In addition, a series of further circuits (two of which are indicated in FIG. 4 as simple squares and which contain the further relays 26 and 27) can be provided for holding these further relays in their closed position under a reduced current.

Referring once again to FIG. 5, this shows a preferred embodiment of the circuit of the present invention, which employs the principle generally described above with reference to FIG. 4. Those elements in FIG. 5 which perform the same functions as corresponding elements in FIG. 4 carry the same reference numerals.

In FIG. 5, the oscillator 16 is a base oscillator comprising three inverting amplifiers mounted in a closed loop. The middle inverting amplifier 16*b* charges a circuit R2, C3 which is disposed between the other two-amplifiers 16*a* and 16*c*. The values of the resistor R2 and capacitor C3 are so chosen as to enable the frequency of the oscillations to be regulated.

The output O of the base oscillator 16 is taken from the common point between the input of the first amplifier 16*a* and the output of the third amplifier 16*c*. This output O is connected to one particular form of the combination circuit 17. In this form, it comprises a D-type flip-flop 16*d*, the clock input Clk of which receives the output O. Another input D of the flip-flop 16*d* is put in the logic state "1" by connection to the supply voltage Vcc. A further output Q of the flip-flop 16*d* is connected to the zeroing terminal R of the flip-flop, via a circuit R5, C5 which introduces a predetermined time delay into the reversion of the flip-flop 16*d* to zero.

In addition, in the block indicated in broken lines in FIG. 5 at 28, there is shown one form of a contact adhesion pulse generator for the relays which are supplied by means of this supply circuit. The generator 28 receives the closing command signal E, which is transmitted to a clock input Clk of a D-type flip-flop 28*b*, the output Q of which is looped on to its zeroing input R through a circuit R8, C7 which maintains the zeroing signal over a sufficiently long period ta to produce the closing voltage for the relay. In addition, the output voltage Vcc of the voltage generator 15 is connected to ground M through another circuit which consists of a resistor R7 and a capacitor C6 in series.

The common point between R7 and C6 is connected through an inverting amplifier 28*c* and a diode D5 to the zeroing input R, in such a way as to cause the D-type flip-flop 28*b* to revert to zero when a voltage is applied to the circuit, i.e. when Vcc changes from 0 volts to its nominal value. The command signal E is transmitted to a first input of an AND gate 17*a*, while the output of the oscillator 16 is passed to a second input of the AND gate 17*a*.

Starting from the output Q of the flip-flop 16*d*, the complete oscillator 16 includes a circuit which comprises a coupling resistor R6 and a switching transistor T1. The base of the transistor T1 is connected to the resistor R6, while a capacitor C4 is connected between the emitter and the collector of the transistor T1. A further resistor R4 is connected in parallel with a capacitor C4. The emitter-collector circuit of the transistor T1 is put, on the collector side, at the supply voltage Vp through a resistor R3, while on the emitter side it is connected to ground.

The common point between the resistors R3 and R4, the capacitor C4, and the collector of the transistor T1, is connected to the input of an inverting amplifier 16*e*, the output of which constitutes the output of the oscillator or oscillation generator 16. This inverting amplifier 16*e* provides a threshold voltage Vt. The circuit 18 further comprises three NOT-AND gates 18*a*, 18*b* and 18*c* connected in parallel. The respective first inputs of these gates are connected to the output of the gate 17*a*, while their respective second inputs are connected to the output of the flip-flop 28*b*. This arrangement increases the amount of current available on the bases of the transistors T2, T3 etc., which control opening and closing of the contacts of the relays 25, 26 etc..

More particularly, in order to ensure adhesion of the relay contacts, a "1" logic signal is transmitted to the input E. The output Q of the flip-flop 28*b* at once changes to "1" while its complementary output Q' changes to "0". The output Q' is passed to a first input of the gates 18*a* to 18*c*, the second inputs of which receive a "0" signal from the output of the gate 17*a*. Accordingly, the outputs of the gates 18 are in the "1" state, and supply an adequate current to control the transistors T2, T3 etc.

The change to the "1" level in the output Q of the flip-flop 28*b* charges the capacitor C7 which, after a time delay which is determined by the time constant defined by R8 and C7, applies a "1" logic signal to the zeroing input R of the flip-flop 28*b*. As a result, its output Q passes to "0", while its output Q' changes to "1", and the command E remains at the "1" level so long as it is required for maintaining the relays in their closed state. Therefore it will be seen that the charging time defined by the resistor R8 and capacitor C7 determines the length of the anti-rebound period ta (FIG. 2) in which the full voltage is applied to the relay coils, thus ensuring that the relay contacts remain firmly in contact with each other.

The oscillations supplied by the oscillator 16*e* are passed to the gate 17*a*, and then through the gates 18 to the control electrodes of the transistors T2, T3 etc. These control electrodes will of course comprise their gates if they are transistors of the MOS type, or their bases if they are bipolar transistors with a common emitter. In this connection, since the signal E is at the "1" level, and since it is transmitted to the first input of the gate 17*a*, the second input of the latter, which receives the oscillations from the flip-flop 16*e*, is passed to its output in the form of oscillations. The chopped supply, or holding, phase (12 in FIG. 2) described above is maintained so long as the signal E is held at the "1" level, i.e. until the instant 12*a* in FIG. 2; it starts when the output Q' of the flip-flop 28*b* is put at the "1" level, that is to say when the other output Q is returned to the "0" level after the anti-rebound phase ta in FIG. 2. In order to terminate the control of the relays 25, 26 etc., the command signal E is changed to the "0" level, as represented by the extinguishing contact 13, or descending part of the curve at the right hand side of FIG. 2. The output from the gate 17*a* remains at the "1" level, while the output of the gates 18 remains at the "0" level; the effect of this is to remove the control signals from the transistors T2, T3 etc.

The inverting amplifier 28*c* has its input connected to the common point between the resistor R7 and capacitor C6. The other side of the capacitor C6 is connected to ground, while the other side of the resistor R7 is connected to the supply line of the circuit at the unidirectional voltage Vcc. For this reason, it is possible to return the supply system to zero when the voltage Vcc is applied to it, by means of the diode D5, the cathode of which is also connected to the zeroing input R of the flip-flop 28*b*. Thus, when the electrical supply is connected to the system, the voltage Vcc changes from zero to, for example, 12 volts. The associated rising front is detected by measuring the charging voltage of the capacitor C6 through the resistor R7. When the voltage across the capacitor C6 exceeds a threshold voltage at which the inverting amplifier (or gate) 28*c* changes state, the zeroing pulse which is produced at the output of the gate 28*c* as soon as a voltage has been applied, reverts to zero. After this reversion of the supply system to zero, the circuit R7, C6 and 28*c* is no longer operative until the next time a voltage is applied.

Figure 6:
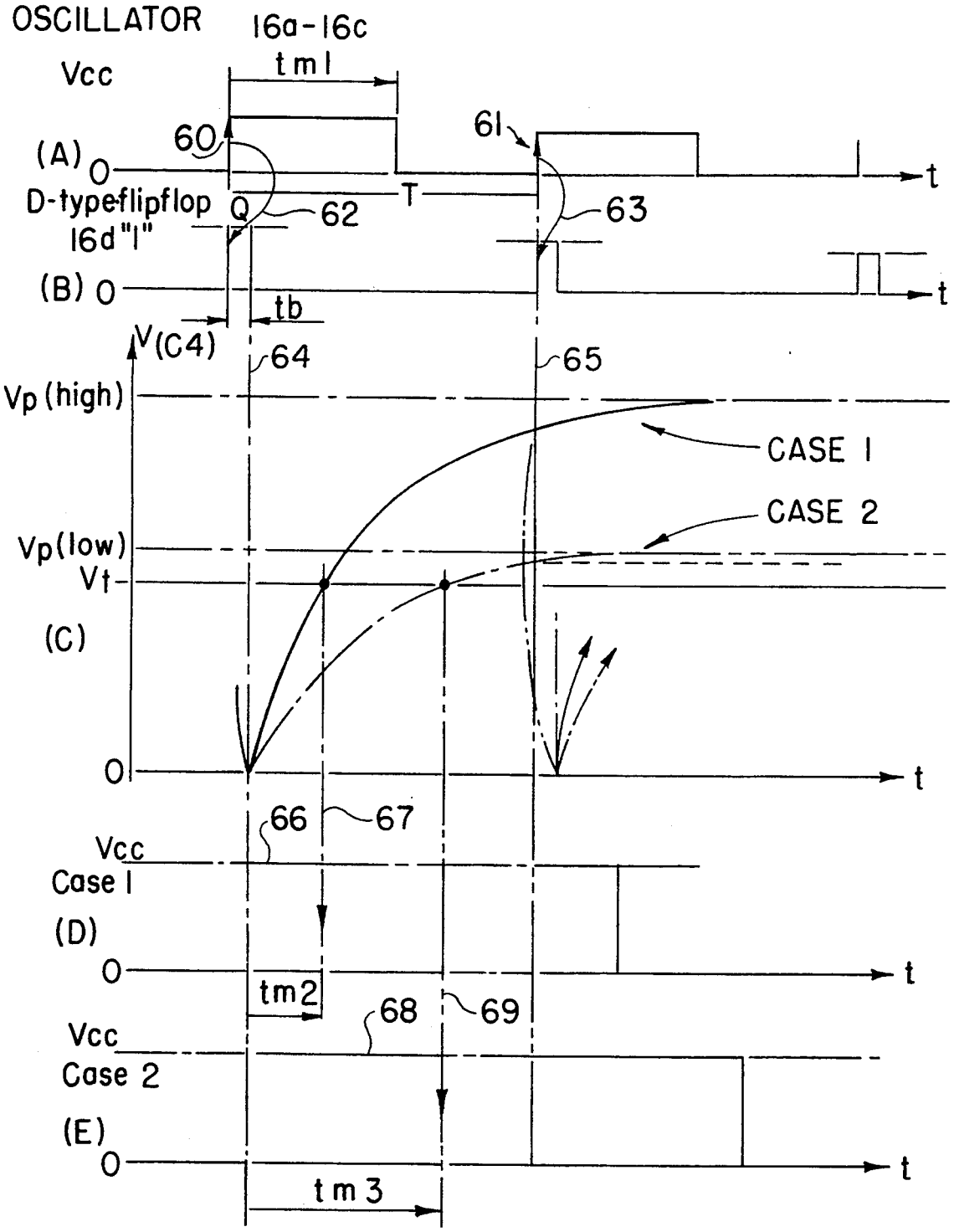
FIG. 6 consists of five diagrams (a) to (e), showing various signals and voltages in one operating mode of the circuit shown in FIG. 5.

Reference is now made to FIG. 6. As shown in the time diagram of FIG. 6(*a*), the base oscillator 16 chops the voltage Vp with a constant period T, (compare tm1 and T). Each rising front 60, 61 arms the D-type flip-flop 16*d* so that its output Q changes to the logic state "1", as indicated in the time diagram of FIG. 6(*b*). However, as shown in FIG. 6(*b*), the output Q remains at "1" for only a brief period of time tb, adjusted by the reversion of the flip-flop 16*d* to zero on its input R in response to charging of the capacitor C5 through the resistor R5. The output pulse Q, seen in FIG. 6(*b*), causes the transistor T1 to become conductive, so that it instantaneously discharges the capacitor C4 on each cycle.

FIG. 6(*c*) shows two cases indicated as "Case 1" and "Case 2", each represented by a curve showing the variation with time of the voltage V across the capacitor C4. In Case 1, the polarizing voltage Vp is high, while in Case 2 it is low. In both cases, charging of the capacitor C4 is initiated by a transition from the logic state "1" to the logic state "0" at the output Q of the flip-flop 16*d*, as indicated by the vertical phantom line 64 common to FIGS. 6 (*b*) to (*e*). Similarly the commencement of discharge of this capacitor is initiated by a transition from the logic state "0" to the logic state "1" at the same output Q, as indicated by the vertical phantom line 65 common to all the parts of FIG. 6. Thus, when the output remains at "1" over the time period tb, the transistor T1 acts as a short circuit across the capacitor C4, which accordingly discharges at once. When the transistor T1 is thus blocked (short control pulse), the capacitor C4 once again becomes charged until it reaches the changeover threshold Vt (FIG. 6(*c*)) of the inverting amplifier 16*e*.

In one embodiment, the charging voltage of the capacitor C4 is the voltage Vp produced by the vehicle in which the system is installed. This is also the high voltage which is applied to the relays. This voltage Vp is in fact generally produced by the vehicle battery, the output voltage of which can often vary, especially in response to calls for current from other parts of the vehicle, such as electric motors or lighting equipment. In addition, when Vp is high (e.g. in the case where the demands on the battery are small), the time taken in waiting for the inverting amplifier 16*e* (or gate) to change its state will be short. Conversely, if Vp is low (e.g. when the battery is discharged or when the demands on it are high), this delay time will be quite long. In this way a chopping effect is produced with a period which is inversely proportional to the supply voltage, so that the cyclic ratio of the pulses produced in order to hold the relays energised by the system determines a constant holding voltage which is independent of the supply voltage Vp produced by the vehicle. This can be expressed as follows:

$$Vp\ (\text{high}) \times (tm2/T) = Vp\ (\text{low}) \times (tm3/T) = Vm.$$

This can be seen in FIGS. 6(*d*) and 6(*e*), which are drawn on the same time scale as FIGS. 6(*a*) to 6(*c*). In this connection, the holding voltage is obtained as a mean value, through the cyclic ratio of the crenellations. This is the ratio between the output signal from the base oscillator 16 over a period which is tm2 in Case 1, FIG. 6(*d*), or tm3 in Case 2, FIG. 6(*e*), and the chopping period T. In particular, the descending front of the crenellation 66 is obtained when the voltage V across the capacitor C4 falls below the changeover threshold voltage Vt, FIG. 6(*c*) of the inverting amplifier 16*e* at the instant 67, as shown in FIG. 6(*d*). Similarly, the descending front of the crenellation 68 occurs at the instant 69 in FIG. 6(*e*).

What is claimed is:

1. A supply circuit, for at least one electromagnetic relay having a relay coil and a pair of relay contracts associated with the coil for movement between a closed position and an open position, the supply circuit having input means for receiving an opening command signal for the opening of said relay and a closing command signal for closing said relay, the supply circuit being arranged to be activated by said closing command signal and deactivated by said opening command signal, wherein the supply circuit comprises a chopping circuit having means for connection to a source of a unidirectional supply voltage, and being arranged to chop said supply voltage according to a predetermined cyclic ratio, for supplying said relay at an intermediate voltage lower than the voltage necessary to ensure initial closing of the relay contacts, and with a low current, said cyclic ratio, intermediate voltage and low current being a predetermined holding voltage to hold the relay contacts closed.

2. A supply circuit according to claim 1, including means defining an electrical ground wherein the chopping circuit comprises a unidirectional voltage generator having a first input, a second input and an output, said first input being connected to said supply voltage and the second input being connected to ground, said voltage generator being such as to produce a unidirectional voltage at its output, the supply circuit further including a logic ground circuit connected so as to receive the voltage output from said voltage generator, and a Zener diode having a cathode defining a constant voltage source output connected to the output of the voltage generator, and an anode connected to ground, the supply circuit further including a first resistor connected between the anode of the Zener diode and said supply voltage.

3. A supply circuit according to claim 1, wherein the chopping circuit further includes an oscillator defining a period predetermined as a function of said holding voltage.

4. A supply circuit according to claim 3, further comprising a composing circuit, said composing circuit having an adding circuit with an output, and an interrupter having an output connected to the output of the adding circuit, the adding circuit further having a first input connected to the output of said oscillator for receiving output signals from said oscillator, and a second input for receiving said closing command signal, the adding circuit producing an output signal which corresponds to the oscillations of predetermined period when the closing command signal is present, the interruptor further having a first input connected for receiving a voltage the value of which is the highest value available to the supply circuit, and a second input connected to ground, the interrupter connecting its output to its first and second inputs selectively by switching in response to the output signal from the adding circuit.

5. A supply circuit according to claim 4, further including a pulse generating circuit for generating a pulse to ensure that the relay contacts remain adhered to each other on being closed, said pulse generator activated by a predetermined charging time for said closing command signal, in order to produce an output signal causing continuous application of the supply voltage to the relay coil for a predetermined time period.

6. A supply circuit according to claim 5, wherein the composing circuit is connected to the chopping and pulse generating circuits and has an output, the supply circuit further including a current amplifier connected for receiving output signals from the composing circuit in response to the chopping and pulse generating circuits.

7. A supply circuit according to claim 6, wherein the current amplifier has an output, and further comprising a relay circuit having a relay and having a control input connected to the output of the current amplifier, the relay circuit being connected between said supply voltage and ground, the relay circuit further including: a switching transistor having its base connected to the control input; a polarizing resistor connected between the base of the switching transistor and the control input, so that the switching transistor can be put into a conductive state by application of a constant voltage produced by the pulse generator to produce a current for closing the relay contacts; and a protection circuit having a capacitor and a protective diode, connected in parallel with the relay coil for limiting over-voltages, so that once the relay contacts have become adhered together, the chopping circuit produces said oscillations, and the latter are amplified in current by the current amplifier and put the switching transistor into alternate conductive and non-conductive states, so as to synthesize the holding voltage across the relay coil so long as transmission of said oscillations is maintained by the closing command signal.

8. A supply circuit according to claim 6, wherein said current amplifier and composing circuit comprise a plurality of NOT-AND gates in parallel, each having a first input and second input, their first inputs being connected to the output of the adding circuit and their second inputs to the output of the pulse generator.

9. A supply circuit according to claim 5, wherein said pulse generator comprises a D-type flip-flop having a control input, an output, and a zeroing input, the chopping circuit having an output for delivering a unidirectional supply voltage to the pulse generator, the control input being connected thereto so as to receive said unidirectional supply voltage, the pulse generator further including a time delay circuit defining a predetermined time constant and connected between the output and the zeroing input of said flip-flop.

10. A supply circuit according to claim 9, further including a circuit connected to the zeroing input of said flip-flop for detecting that a voltage has been applied.

* * * * *